US006366019B1

(12) United States Patent
Wada et al.

(10) Patent No.: US 6,366,019 B1
(45) Date of Patent: Apr. 2, 2002

(54) HIGH-PRESSURE SODIUM LAMP

(75) Inventors: Masato Wada, Hyogo; Akio Takubo, Osaka, both of (JP)

(73) Assignee: Matsushita Industrial Co., Ltd., Osaka (JP)

( * ) Notice: Subject to any disclaimer, the term of this patent is extended or adjusted under 35 U.S.C. 154(b) by 0 days.

(21) Appl. No.: 09/578,231

(22) Filed: May 24, 2000

(30) Foreign Application Priority Data

May 28, 1999 (JP) ..... 11-149716

(51) Int. Cl.[7] ..... H01J 61/36; H01J 17/04

(52) U.S. Cl. ..... 313/623; 313/624; 313/625; 313/631; 313/570

(58) Field of Search ..... 313/623, 624, 313/625, 631, 570, 571, 574, 634

(56) References Cited

U.S. PATENT DOCUMENTS 4,052,635 A 10/1977 Jacobs
4,975,620 A * 12/1990 Masui et al. ..... 313/625 X
5,343,117 A * 8/1994 Wyner et al. ..... 313/623

FOREIGN PATENT DOCUMENTS

JP 52-42673 4/1977
JP 1-57560 3/1989
JP 0004438 * 1/1991 ..... 313/623

* cited by examiner

*Primary Examiner*—Ashok Patel
(74) *Attorney, Agent, or Firm*—Merchant & Gould P.C.

(57) ABSTRACT

An electrode is fixed hermetically to one end of a conductive tube with a titanium solder and the other end of the conductive tube is closed. Thus, the conductive tube has an airtight structure and an argon gas is sealed therein. This conductive tube is fixed hermetically to a transparent alumina tube using a sealer. Further, sodium amalgam is provided at an inner end of the transparent alumina tube. The conductive tube is prevented from being deformed and sodium of a luminescent material is positioned inside the discharge tube, thus providing a high-pressure sodium lamp in which a lighting color and lamp voltage are prevented from varying during the lamp lifetime, the time required for reaching a stable lighting state after turning on the lamp is short, and the variation in lamp voltage is suppressed.

3 Claims, 4 Drawing Sheets

HIGH-PRESSURE SODIUM LAMP

FIELD OF THE INVENTION

The present invention relates to a high-pressure sodium lamp, particularly to a configuration of a discharge tube in a high-pressure sodium lamp with a high color rendering property.

BACKGROUND OF THE INVENTION

FIG. 3 shows an example of the configuration of a discharge tube in a conventional high-pressure sodium lamp. As shown in FIG. 3, this conventional high-pressure sodium lamp includes a conductive tube 33 and an electrode 32 held at one end of the conductive tube 33 using titanium solder 31. The other end of the conductive tube 33 is an open end.

The conductive tube 33 is attached to one end of a transparent alumina tube 34, and a portion of the transparent alumina tube 34 to which the conductive tube 33 is attached is sealed hermetically with a sealer 35 made of ceramic cement. Sodium amalgam 36 is provided at an inner end of the transparent alumina tube 34.

When using the above-mentioned conventional configuration of the discharge tube, however, in a high-pressure sodium lamp with a relatively high sodium-vapor pressure inside the discharge tube in operation, particularly, in a high-pressure sodium lamp with a high color rendering property, the difference in pressure between the inside and the outside of the transparent alumina tube 34 occurs during operation and the transparent alumina tube 34 comes to have a high temperature. As shown in FIG. 4, therefore, a portion in the vicinity of the electrode 32 in the conductive tube 33 might be deformed.

When such deformation occurs, the conductive tube 33 comes off from the sealer 35, thus forming a gap between them. Into this gap, the sodium amalgam 36 intrudes and therefore the sodium of a luminescent material reacts with the sealer 35 over a wide area. Consequently, the loss of the sodium is promoted inside the discharge tube, thus causing problems such as the variation in discharging color or in lamp voltage during the lifetime and the like in some cases.

Therefore, as an example of a configuration for solving such problems, JP 8-399 B discloses a high-pressure sodium lamp in which a conductive tube is prevented from being affected by the difference in pressure between the inside and the outside of a discharge tube and ceramic cement is prevented from being exposed in a discharge space of the discharge tube, thus suppressing the reaction between sodium and the ceramic cement during operation.

However, in the above-mentioned high-pressure sodium lamp disclosed in JP 8-3995 B, sodium amalgam of a luminescent material is maintained not inside the discharge tube but inside the conductive tube, which is the coldest portion, thus causing the following two problems.

The first problem is that heat generated by an arc discharge between electrodes serving as a heat source in operation is intercepted by the electrodes, and the sodium amalgam maintained inside the conductive tube cannot receive the heat easily, thus requiring a long time to reach a stable lighting state after turning on the lamp.

The second problem is that when the conductive tube is displaced in being attached to the discharge tube, the temperature of the coldest portion varies, thus increasing the variation in lamp voltage of manufactured lamp compared to the case where sodium amalgam is provided at the inner end of a discharge tube where the temperature does not vary greatly as shown in FIG. 3.

JP 52-42673 A discloses an example in which a conductive tube has an airtight structure. In the conductive tube, the open end of the conductive tube 33 shown in FIG. 3 is closed and the inside of the conductive tube is shielded from a gaseous substance surrounding the inside of a discharge tube. Thus, the reaction between the portion to be a high temperature in the conductive tube 33 and the gaseous substance surrounding it is prevented. JP 52-42673 A describes the simple shielding but no measures against the deformation caused by a difference in pressure.

The present inventors operated high-pressure sodium lamps with a high color rendering property manufactured to have discharge tubes as shown in FIG. 3 for about 6000 hours and checked a loss amount of sodium in the discharge tubes with a deformed conductive tube and with a non-deformed conductive tube, respectively. As a result, in the discharge tube with a deformed conductive tube, about 50% of the total amount of sodium sealed in the discharge tube was lost. On the other hand, in the discharge tube with a non-deformed conductive tube, about 4% of the total amount of sodium was lost. Thus, it was confirmed that the loss amount in the discharge tube with a non-deformed conductive tube is extremely small compared to that in the discharge tube with a deformed conductive tube.

In addition, the discharge tube with a deformed conductive tube was checked in detail. As a result, about 90% of the loss amount of sodium was caused by the reaction between the sodium and the sealer due to the gap formed by the coming off of the conductive tube from the sealer. In other words, it was confirmed that the reaction between the sodium and the sealer can be suppressed by preventing the conductive tube from being deformed.

SUMMARY OF THE INVENTION

The present invention is intended to provide a high-pressure sodium lamp in which the conductive tube is prevented from being deformed and sodium is provided inside a discharge tube as a luminescent material, whereby a lighting color and lamp voltage are prevented from varying during the lifetime, the time required for reaching a stable lighting state after turning on the lamp is short, and the variation in lamp voltage is suppressed.

In order to achieve the above-mentioned object, a high-pressure sodium lamp of the present invention includes a discharge tube and a pair of electrodes opposing each other inside the discharge tube, and at least sodium and a noble gas are sealed in the discharge tube. The pair of electrodes are held by conductive tubes attached hermetically to both ends of the discharge tube with a sealer, and the conductive tubes have airtight structures and an inert gas is sealed therein.

According to this configuration, in operation, due to the pressure of the inert gas sealed in the conductive tubes, the difference in pressure between portions located inside and outside the discharge tube in the conductive tubes is not caused easily. Further, the heat conduction by the inert gas sealed in the conductive tubes lowers the temperature of portions in the vicinities of the electrodes in the conductive tubes. As a result, the conductive tubes can be prevented from being deformed and coming off from the sealer.

Moreover, since the sodium is sealed in the discharge tube, the sodium of a luminescent material can receive quickly the heat generated by an arc discharge between the electrodes serving as a heat source in operation, and at the same time, the temperature is kept constant. Thus, the time required for reaching a stable lighting state after turning on the lamp is shortened and the variation in lamp voltage during manufacture can be suppressed.

In the above-mentioned high-pressure sodium lamp, it is preferable that the pressure of the inert gas sealed in the conductive tubes is at least 10 Torr.

According to this configuration, the difference in pressure between the portions of the conductive tubes located inside and outside the discharge tube is further reduced, thus more reliably preventing the conductive tubes from being deformed and coming off from the sealer.

In the above-mentioned high-pressure sodium lamp, it is preferable that the portions holding the electrodes in the conductive tubes have a temperature of 800° C. or lower.

According to this configuration, the load on the conductive tubes according to the temperature is suppressed, thus further reliably preventing the conductive tubes from being deformed and coming off from the sealer.

DETAILED DESCRIPTION OF THE INVENTION

FIRST EMBODIMENT

Figure 1:
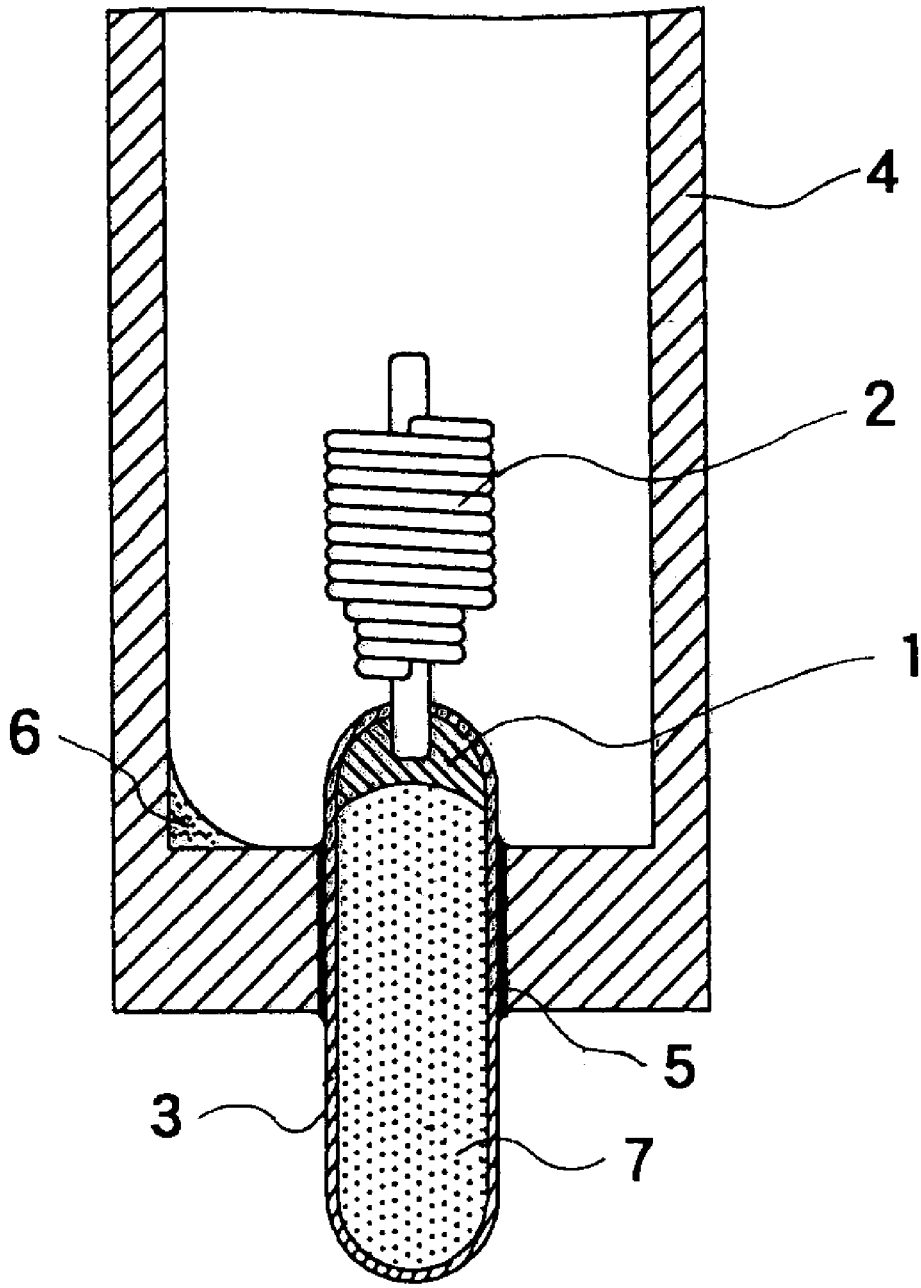
FIG. 1 is a sectional view showing a configuration of an end of a discharge tube in a high-pressure sodium lamp with a high color rendering property according to one embodiment of the present invention.

FIG. 1 is a sectional view showing a configuration of an end of a discharge tube in a high-pressure sodium lamp of 150 W with a high color rendering property according to one embodiment of the present invention. In the discharge tube, a conductive tube 3 for supporting an electrode 2 is attached to each end of a transparent alumina tube 4. FIG. 1 shows only one end of the discharge tube and the other end is not shown in the figure.

The electrode 2 containing an emissive material is fixed hermetically to the one end of the conductive tube 3 with titanium solder 1. The other end of the conductive tube 3 is closed and therefore the conductive tube 3 has an airtight structure. An argon gas 7 of 10 Torr at room temperature is sealed in the conductive tube 3 as an inert gas. The conductive tube 3 is formed of an alloy containing 99% niobium and 1% zirconium and has an outer diameter of 4 mm.

In the transparent alumina tube 4, a portion to which the conductive tube 3 is attached is sealed hermetically with a sealer 5 made of ceramic cement. In addition to 40 Torr of a xenon gas, sodium amalgam 6 including 5 mg of sodium and 13 mg of mercury is sealed in the transparent alumina tube 4. The sodium amalgam 6 is provided in the vicinity of an inner end of the transparent alumina tube 4, which is a coldest portion.

Inside the transparent alumina tube 4, a counter electrode (not shown in the figure) is provided to oppose the electrode 2. The interval between those electrodes is 31 mm. Thermal protection films (not shown in the figure) of tantalum having a thickness of 0.02 mm and a width of 15 mm are provided on the outer surfaces of both ends of the transparent alumina tube 4.

Figure 3:
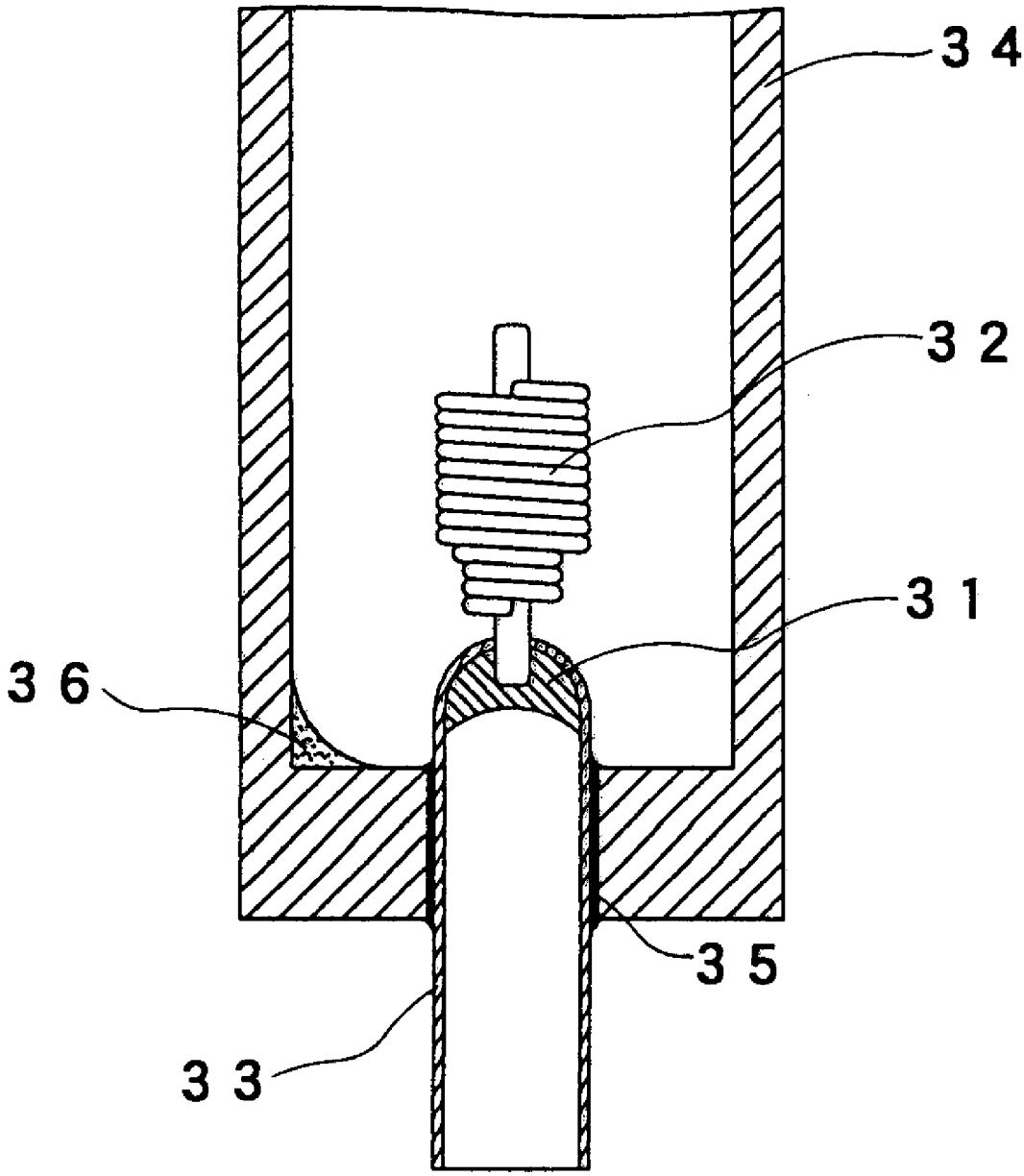
FIG. 3 (PRIOR ART)
FIG. 3 is a sectional view showing a structural example of an end of a discharge tube in a conventional high-pressure sodium lamp.
Figure 4:
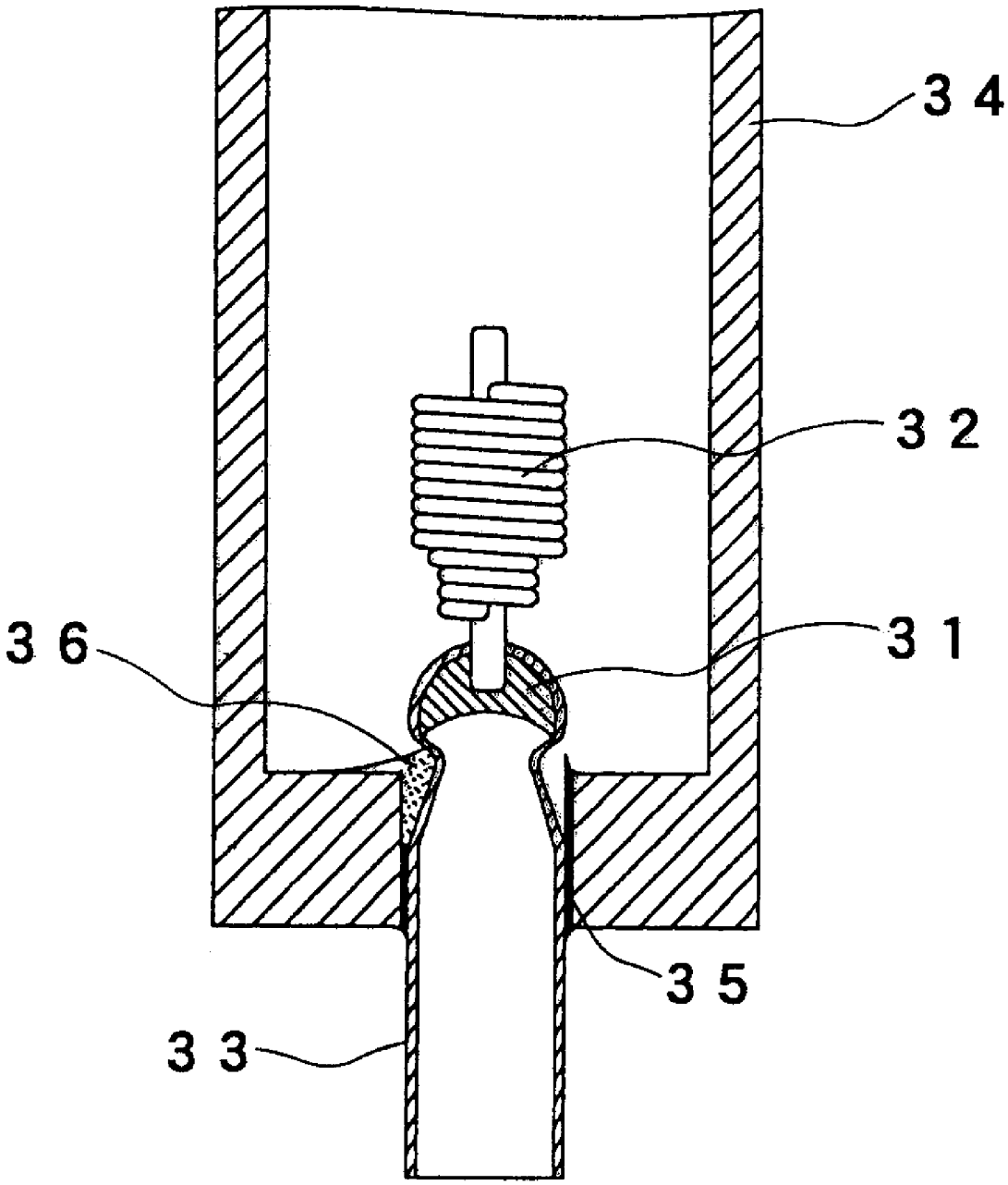
FIG. 4 (PRIOR ART)
FIG. 4 is a sectional view showing the state in which a conductive tube has been deformed in the conventional high-pressure sodium lamp shown in FIG. 3.

The discharge tubes according to the present embodiment with the above-mentioned configuration and the conventional discharge tubes shown in FIG. 3 were incorporated in outer tubes made of hard glass (not shown in the figure) with an outer diameter of 40 mm, thus forming 20 lamps each. Then, lamp voltages of the respective lamps were checked right after their manufacture.

As a result, the variation in lamp voltage was 6.5 V in the conventional discharge tubes. On the other hand, the variation in lamp voltage was 3.4 V in the discharge tubes according to the present embodiment. Further, the time required for reaching a stable lighting state after turning on the lamp was checked. As a result, it took about 15 minutes in the conventional discharge tubes. On the other hand, it took about 8 minutes in the discharge tubes according to the present embodiment. In other words, considerable improvement both in the variation in lamp voltage and in the time required for reaching a stable lighting state was confirmed in the discharge tubes according to the present embodiment.

In the lamp according to the present embodiment, the temperature of a conductive tube portion affected by the difference in pressure between the inside and the outside of the discharge tube, i.e. the temperature of a portion in the vicinity of the electrode 2 in the conductive tube 3 was measured and was about 800° C. On the other hand, the temperature was about 840° C. in the conventional lamp shown in FIG. 3. In other words, according to the configuration of the present embodiment, the temperature of the conductive tube portion affected by the difference in pressure between the inside and the outside of the discharge tube is lower by about 40° C. compared to that in the conventional configuration.

The conventional lamp with a configuration shown in FIG. 3 and the lamp according to the present embodiment were operated for 12000 hours with a flashing cycle in which the lamps were operated for 5.5 hours and then were turned off for 0.5 hour repeatedly. In the lamp according to the present embodiment, neither the deformation in the conductive tube nor the variation in lighting color was found, and the characteristics during the lifetime also were stable. On the other hand, in the conventional lamp with the configuration shown in FIG. 3, the conductive tube was deformed.

As described above, according to the configuration of the discharge tube obtained by closing both ends of the conductive tube 3, sealing an inert gas therein, and attaching the conductive tube 3 hermetically to the transparent alumina tube 4 with the sealer 5, the time required for reaching a stable lighting state after turning on the lamp is shortened while the variations in lighting color and lamp voltage during the lifetime are prevented, and further the variation in lamp voltage can be suppressed.

It is preferable that the pressure of the inert gas sealed in the conductive tube 3 is set to be at least 10 Torr. According to this, the difference in pressure between the portions located inside and outside the transparent alumina tube 4 in the conductive tube 3 is further reduced, thus more reliably preventing the conductive tube 3 from being deformed and coming off from the sealer 5.

Since the inert gas is sealed in the conductive tube 3, due to heat conduction by the inert gas, the temperature of the portion holding the electrode 2 in the conductive tube 3 can be suppressed to be lower than that in the conventional lamp, preferably to be 800° C. or lower. According to this, the load on the conductive tube 3 according to the temperature can be suppressed, thus further reliably preventing the conductive tube 3 from being deformed and coming off from the sealer 5.

Furthermore, in the configuration of the present embodiment, the sodium amalgam 6 provided inside the transparent alumina tube 4 is positioned constantly at the inner end of the transparent alumina tube 4, which is the coldest portion. Therefore, the sodium amalgam 6 can receive quickly the heat generated by an arc discharge between the electrodes serving as a heat source in operation and the temperature of the coldest portion is kept constant. Thus, the time required for reaching a stable lighting state after turning on the lamp is shortened and the variation in lamp voltage can be suppressed.

SECOND EMBODIMENT

Figure 2:
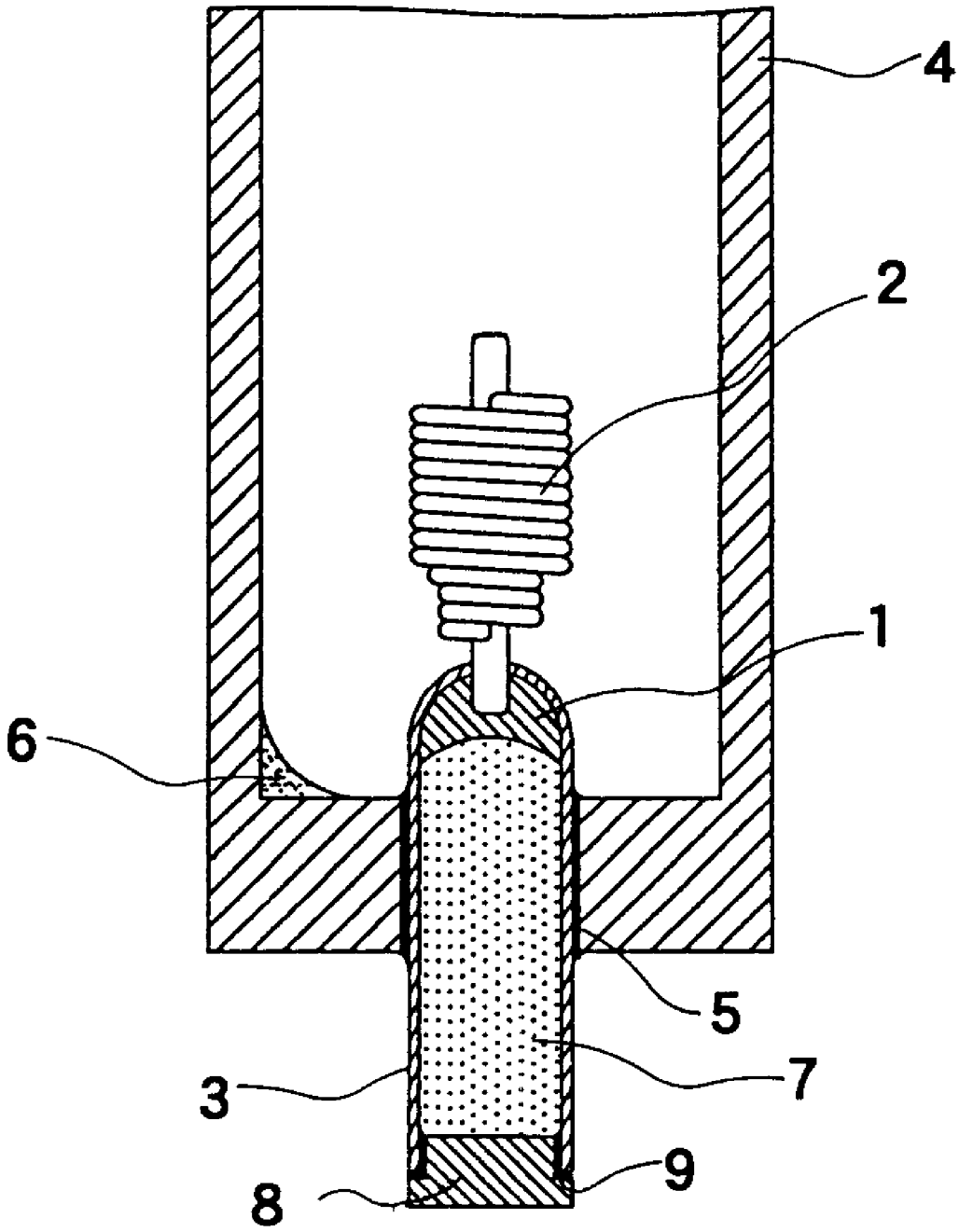
FIG. 2 is a sectional view showing a configuration of an end of a discharge tube in a high-pressure sodium lamp with a high color rendering property according to another embodiment of the present invention.

FIG. 2 is a sectional view showing a configuration of an end of a discharge tube in a high-rendering high-pressure sodium lamp of 150 W according to another embodiment of the present invention. In the discharge tube of the lamp according to the present embodiment, one end opposite to the end holding an electrode in a conductive tube 3 is closed with a ceramic cap 8 and a sealer 9 made of ceramic cement. An inert gas was sealed in the conductive tube 3. Except for this, the discharge tube has the same configuration as that of the discharge tube in the lamp according to the first embodiment.

As described above, according to the configuration of the discharge tube obtained by closing both ends of the conductive tube 3, sealing the inert gas (an argon gas) therein, and attaching the conductive tube 3 hermetically to a transparent alumina tube 4 with a sealer 5, the time required for reaching a stable lighting state after turning on the lamp is shortened while the variations in lighting color and lamp voltage during the lifetime are prevented, and further the variation in lamp voltage can be suppressed.

It is preferable that the pressure of the inert gas sealed in the conductive tube 3 is set to be at least 10 Torr. According to this, the difference in pressure between the portions located inside and outside the transparent alumina tube 4 in the conductive tube 3 is further reduced, thus more reliably preventing the conductive tube 3 from being deformed and coming off from the sealer 5.

Since the inert gas is sealed in the conductive tube 3, due to heat conduction by the inert gas, the temperature of the portion holding the electrode 2 in the conductive tube 3 can be suppressed to be lower than that in the conventional lamp, preferably to be 800° C. or lower. According to this, the load on the conductive tube 3 according to the temperature can be suppressed, thus further reliably preventing the conductive tube 3 from being deformed and coming off from the sealer 5.

In the configuration of the present embodiment, the sodium amalgam 6 provided inside the transparent alumina tube 4 is positioned constantly at an inner end of the transparent alumina tube 4, which is the coldest portion. Therefore, the sodium amalgam 6 can receive quickly the heat generated by an arc discharge between the electrodes serving as a heat source in operation and the temperature of the coldest portion is kept constant. Thus, the time required for reaching a stable lighting state after turning on the lamp is shortened and the variation in lamp voltage can be suppressed.

In the respective embodiments described above, the titanium solder 1 was used for fixing the electrode 2. Instead of this, the conductive tube 3 and the electrode 2 may be welded to be fixed hermetically. Further, argon gas was used as the inert gas sealed in the conductive tube 3. Instead of the argon gas, other inert gases such as a nitrogen gas, a xenon gas, or a krypton gas may be used and two or more inert gases may be mixed and sealed therein.

In the respective embodiments described above, the lamp voltage was 150 W, but is not limited to this. Furthermore, the present invention may be applied not only to the high-rendering high-pressure sodium lamp but also a general high-pressure sodium lamp. In that case, the same effects can be obtained.

As described above, according to the present invention, the conductive tube is prevented from being deformed, thus providing a high-pressure sodium lamp with stable lifetime characteristics in which the time required for reaching a stable lighting state after turning on the lamp is short and the variation in lamp voltage is suppressed.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A high-pressure sodium lamp, comprising a discharge tube and a pair of electrodes opposing each other inside the discharge tube, at least sodium and a noble gas being sealed in the discharge tube, wherein the pair of electrodes are held by conductive tubes attached hermetically to both ends of the discharge tube with a sealer, and the conductive tubes have airtight structures and an inert gas is sealed therein.

2. The high-pressure sodium lamp according to claim 1, wherein a pressure of the inert gas sealed in the conductive tubes is at least 10 Torr.

3. The high-pressure sodium lamp according to claim 1, wherein portions holding the electrodes in the conductive tubes have a temperature of 800° C. or lower during use.

* * * * *